US005079855A

United States Patent [19]

Carrier

[11] Patent Number: 5,079,855

[45] Date of Patent: Jan. 14, 1992

[54] DRYING CHAMBER AND AIR DISTRIBUTION MEANS THEREFOR

[75] Inventor: Normand E. Carrier, Pawtucket, R.I.

[73] Assignee: Carrier Associates, Inc., Pawtucket, R.I.

[21] Appl. No.: 655,749

[22] Filed: Feb. 15, 1991

[51] Int. Cl.[5] ..... F26B 19/00

[52] U.S. Cl. ..... 34/225; 34/230; 34/231

[58] Field of Search ..... 34/204, 237, 238, 230, 34/231, 232, 233, 225, 224; 98/36

[56] References Cited

U.S. PATENT DOCUMENTS

| | | | |
|---|---|---|---|
| 285,957 | 10/1883 | Belcher | 34/237 |
| 1,011,971 | 12/1911 | Kukkuck | 34/238 |
| 1,518,752 | 12/1924 | Perkins | 34/78 |
| 1,611,632 | 12/1926 | Cantoni | 34/204 |
| 3,324,844 | 6/1967 | Huffman | 34/225 |
| 3,367,043 | 2/1968 | Torigian | 34/238 |
| 4,028,816 | 6/1977 | Macy et al. | 34/238 |
| 4,409,743 | 10/1983 | Jespersen et al. | 34/233 |
| 4,458,815 | 7/1984 | Mollman et al. | 34/237 |
| 4,837,945 | 6/1989 | Wulf et al. | 34/204 |
| 4,840,040 | 6/1989 | Fung | 98/36 |

*Primary Examiner*—Henry A. Bennet
*Assistant Examiner*—Denise L. F. Gromada
*Attorney, Agent, or Firm*—Salter & Michaelson

[57] ABSTRACT

A drying chamber for curing products, such as confectionery, loaded on a plurality of rows of stacked trays, the chamber having novel and improved means for evenly supplying, distributing and exhausting conditioned air.

8 Claims, 4 Drawing Sheets

DRYING CHAMBER AND AIR DISTRIBUTION MEANS THEREFOR

BACKGROUND OF THE INVENTION

This invention relates generally to drying chambers or areas for curing products to a desired degree of solidification.

A primary use of drying chambers of this type is in the manufacture of candy products, wherein it is necessary to solidify the candy to a desired degree. This drying or curing operation is essential in such candy products as medium-soft candy, orange slices, jelly beans, and nougats, by way of example. Although this invention is primarily applicable to the manufacture of such candy products, it obviously has utility for other products that require some degree of curing, such as lumber, for example.

Drying chambers of the general type with which the instant invention is concerned have been in use for a great number of years, and as early as 1921, Carrier Air Conditioning Corporation developed a method that effected drying and processing of materials by means of conditioned air. As used herein, and throughout this application, the term "conditioned air" refers to air that has been treated so as to maintain a desired temperature and desired moisture control.

In the Carrier system, as well as the present invention, the products to be dried or cured are loaded on a plurality of rows of stacked trays, the design and configuration of the trays being such that a horizontally disposed air space exists between each tray and the tray immediately above and below it. In addition, vertical air spaces exist between adjacent rows of the stacked trays, which trays substantially completely fill the drying chamber or area. Means are provided for introducing and exhausting conditioned air so that the conditioned air is circulated and distributed throughout the chamber in order to effect the desired curing of the products that are positioned on the trays. The problem that has existed, however, is to achieve a highly uniform and even distribution of conditioned air within the chamber in order that the curing of the products mounted on the trays will be uniform. Without highly efficient and uniform air distribution, it will be obvious that some of the products being cured will be solidified to a greater degree than others, which is obviously very undesirable.

It is therefore a principal object of the present invention to provide a novel and improved drying chamber having air distribution means wherein the conditioned air introduced to the chamber is circulated in such a way as to provide a controlled, extremely even air flow throughout the chamber, whereby there will be a relatively even and uniform curing of all of the products within the chamber.

SUMMARY OF THE INVENTION

The key feature of this invention involves the use of a unique and novel wall module system comprising a plurality of plenums in side-by-side relation so as to cover at least one, and preferably opposite longitudinal walls of the drying chamber. Each plenum comprises a housing having front and rear walls, end walls, a bottom wall, and an open top, the plenum extending from a point adjacent the ceiling of the chamber to a point adjacent to, but spaced slightly above, the floor of the chamber. A plurality of side-by-side supply tubes extend through the interior of each plenum, and through the bottom wall thereof, terminating in open bottom ends located adjacent but somewhat above the floor of the chamber. The front wall of each plenum, i.e., the wall that faces the interior of the chamber, is provided with a multitude of small orifices evenly distributed throughout said wall so as to provide a perforated or foraminous surface.

By means hereinafter to be described, conditioned air is introduced to the supply tubes, while at the same time a suction or negative pressure is applied to the interior of each plenum, i.e., the space within each plenum not occupied by the supply tubes.

Since the conditioned air is introduced to the supply tubes with some degree of pressure, i.e., is blown therein, said conditioned air passes downwardly through the tubes and exits from the open bottoms thereof, and where such plenums are mounted on the opposite walls of the chamber, the conditioned air exiting from the side-by-side supply tubes forms a web of conditioned air that moves inwardly from opposite sides of the chamber beneath the pallets on which the stacked trays are mounted until said opposed webs meet each other at approximately the center of the chamber, merge into one, and then move upwardly through the vertical air space that is present at the approximate center of the chamber between adjacent rows of stacked trays. By controlling the volume and velocity of the conditioned air introduced to the supply tubes, it is possible to predetermine the distance that the webs will travel horizontally underneath the pallets before the energy contained therein is dissipated, at which point the merged webs of air tend to move vertically upward through the vertical air space, because the conditioned air is lighter in density, i.e., drier, than the ambient air in the chamber. As the conditioned air move upwardly at the center of the chamber between adjacent rows of stacked trays, the suction or negative pressure that has been applied to the interior of the plenums communicates with the chamber interior through the foraminous front wall of each plenum, thereby sucking the conditioned air horizontally outward through the horizontal spaces between adjacent trays so as to effect the desired drying and curing of the products positioned on the trays. The conditioned air is drawn into the interior of the plenums and then is exhausted therefrom by means hereinafter to be described.

Thus, it is the return air flow that actually controls the air circulation and the foraminous nature of the front walls of the plenums result in an extremely even air-return rate over the entire wall surface, which in turn results in extremely even and uniform drying or curing of all of the products, whether it be candy or whatever, present in the chamber.

Other objects, features and advantages of the invention shall become apparent as the description thereof proceeds when considered in connection with the accompanying illustrative drawings.

DESCRIPTION OF THE DRAWINGS

In the drawing which illustrates the best mode presently contemplated for carrying out the present invention.

DESCRIPTION OF THE PREFERRED FORM OF THE INVENTION

Figure 1:
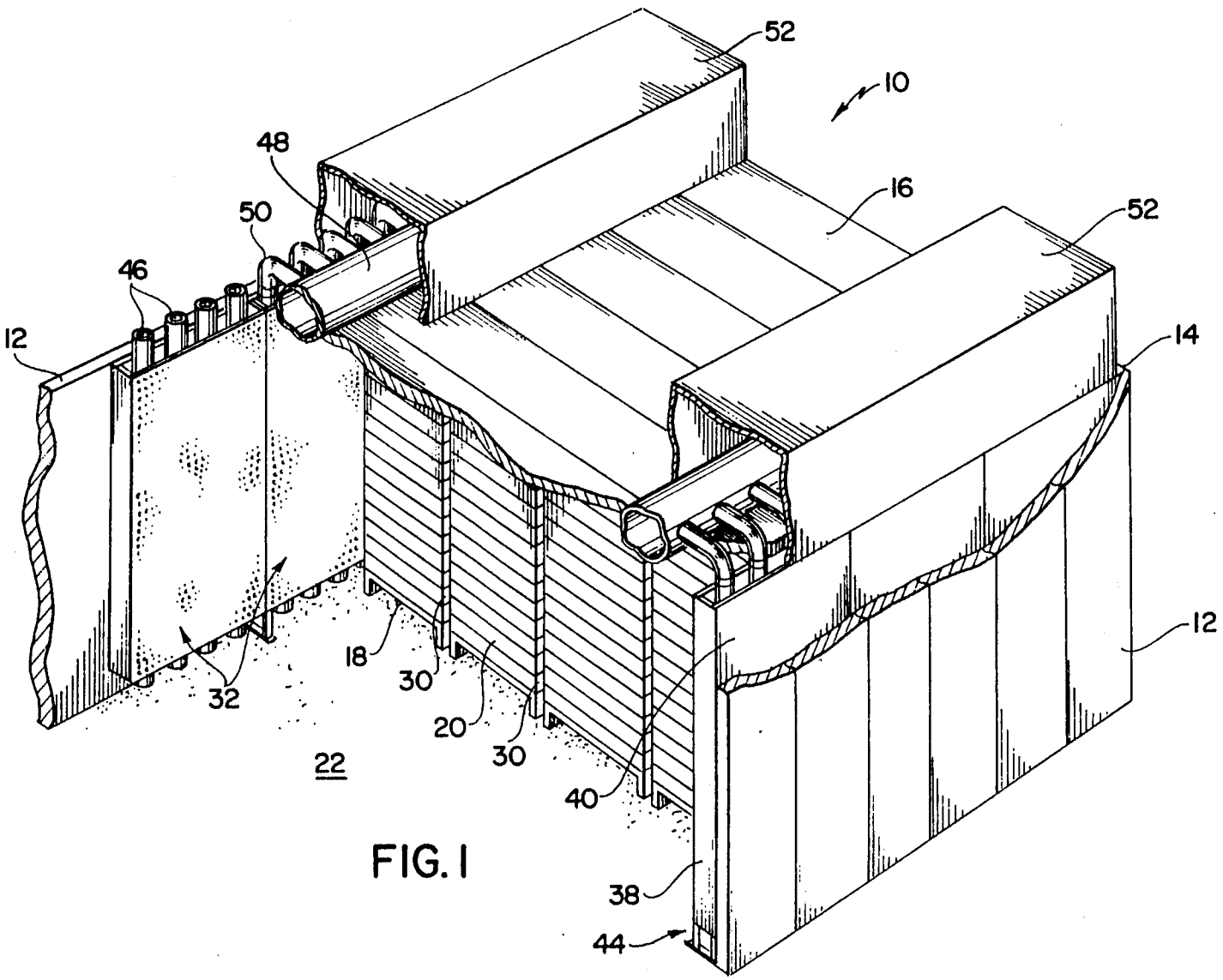
FIG. 1 is a perspective elevational view of the drying chamber of the present invention, with portions broken away for purposes of illustration.
Figure 2:
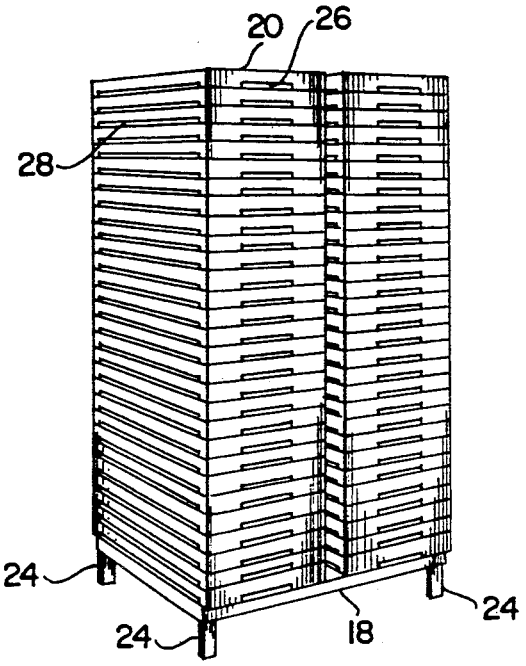
FIG. 2 is a perspective view of a pallet and tray unit of the type employed in the present invention.
Figure 4:
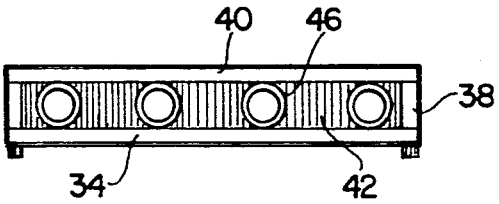
FIG. 4 is a top view of the plenum shown in FIG. 3.
Figure 5:
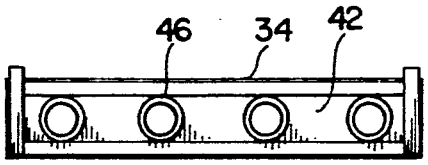
FIG. 5 is a bottom view of the plenum shown in FIG. 3.

Referring to the drawings, and more particularly FIG. 1 thereof, there is shown generally at 10 a drying chamber comprising side walls 12, end walls 14, and ceiling 16, all preferably of modular construction made from any structurally strong impermeable material, such as cinder block or concrete for the walls, and interlocking metal-clad foam modules for the ceiling. The chamber 10 is adapted to receive therein pallets 18 (note FIG. 2) having a plurality of rows of stacked trays 20 thereon, it being noted that in the embodiment shown, there are two rows of trays stacked on each pallet, it being further noted that the pallets 18 are spaced above the floor 22 of chamber 10 by means of legs 24 provided at each corner of the trays 18. The trays 20 are of conventional construction and are designed so that when the trays are stacked on each other, horizontal air spaces 26, 28 exist between adjacent trays. As will be seen most clearly in FIG. 1, the illustrated embodiment of my invention shows four of the pallets 18 in side-by-side relation, with vertical air spaces 30 between adjacent rows.

Figure 3:
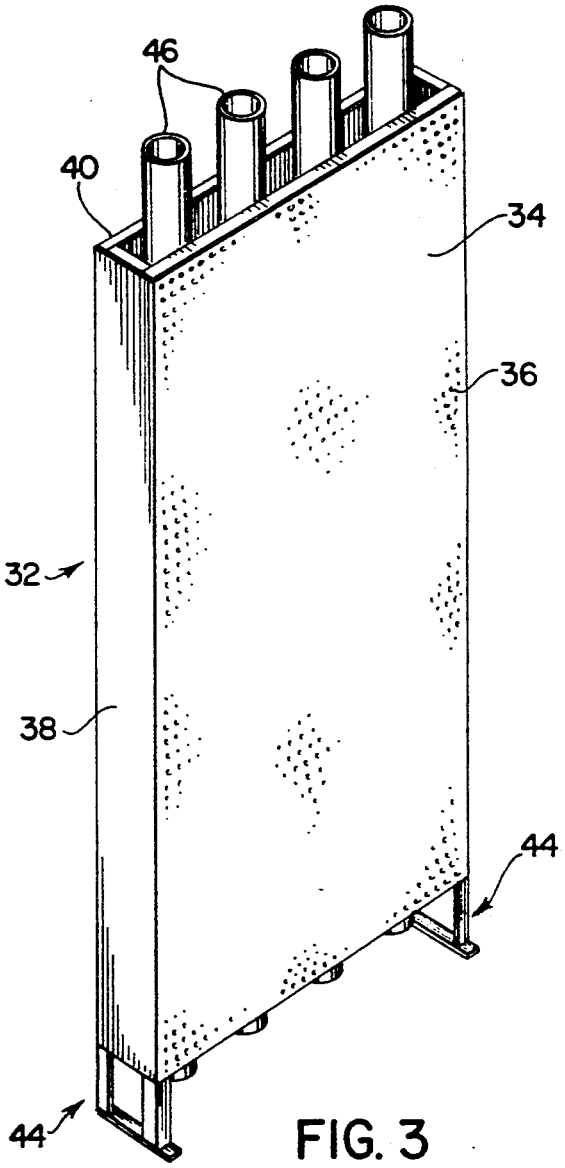
FIG. 3 is an enlarged perspective view of one of the modularized wall plenums that form a part of my invention.

The opposite side walls 12 of chamber 10 are provided with a plurality of plenums shown generally at 32, said plenums being in side-by-side relation so as to extend for the entire length of each side wall 12. As will be seen most clearly in FIG. 3, each plenum 32 comprises a front wall 34 having a multitude of small perforations 36 therein so as to provide a foraminous surface. Preferably the perforations 36 are approximately 1/16" in diameter with the sum of all the openings comprising approximately 20% to 25% of the wall surface. Plenum 32 further comprises side walls 38, rear wall 40, and bottom wall 42. Each plenum 32 has supporting stanchions shown generally at 44, which stanchions are secured to the floor of chamber 10 by any suitable means. The plenums 32 are preferably constructed of sheet metal, and as will be noted from FIGS. 1 and 3, bottom wall 42 of each plenum is elevated above the floor 22 of the chamber, it being further noted that the top of each plenum has no cover thereon. Actually, it is not essential that the intermediate plenums in the row have end walls 38, although it is essential that the outermost plenums of each row have such end walls at their outer ends so as to cooperate with the front, rear and bottom walls of the individual plenums so as to define a substantially enclosed continuous space or chamber within the plenums.

Extending through each plenum is a plurality of supply tubes 46, said tubes at their upper extremities being connected to an inlet manifold 48 by means of connecting elbows 50. The supply tubes 46, preferably four for each plenum, extend downwardly through the plenum in side-by-side relation, through bottom wall 42 of each plenum, and then terminate slightly below bottom wall 42 but at the same time in elevated relation to floor 22. Preferably, the cross-sectional area of the return space in each plenum is approximately 2 to 3 times the total cross-sectional area of the tubes 46. In order that the tubes 46 may pass upwardly above each plenum, it will be noted that ceiling 16 is secured to the top edge of the front walls 34, i.e., the ceiling does not extend across the open tops of the plenums, as shown most clearly in FIG. 7.

As will be seen in FIG. 1, manifolds 48 each extend longitudinally through exhaust chambers or manifolds 52, which exhaust chambers communicate with the suction side of blower 54 by means of T-shaped conduit 56. The pressure side of blower 54 is in turn connected by means of T-shaped conduit 58 to the inlet manifolds 48, all as most clearly shown in FIG. 6.

Figure 6:
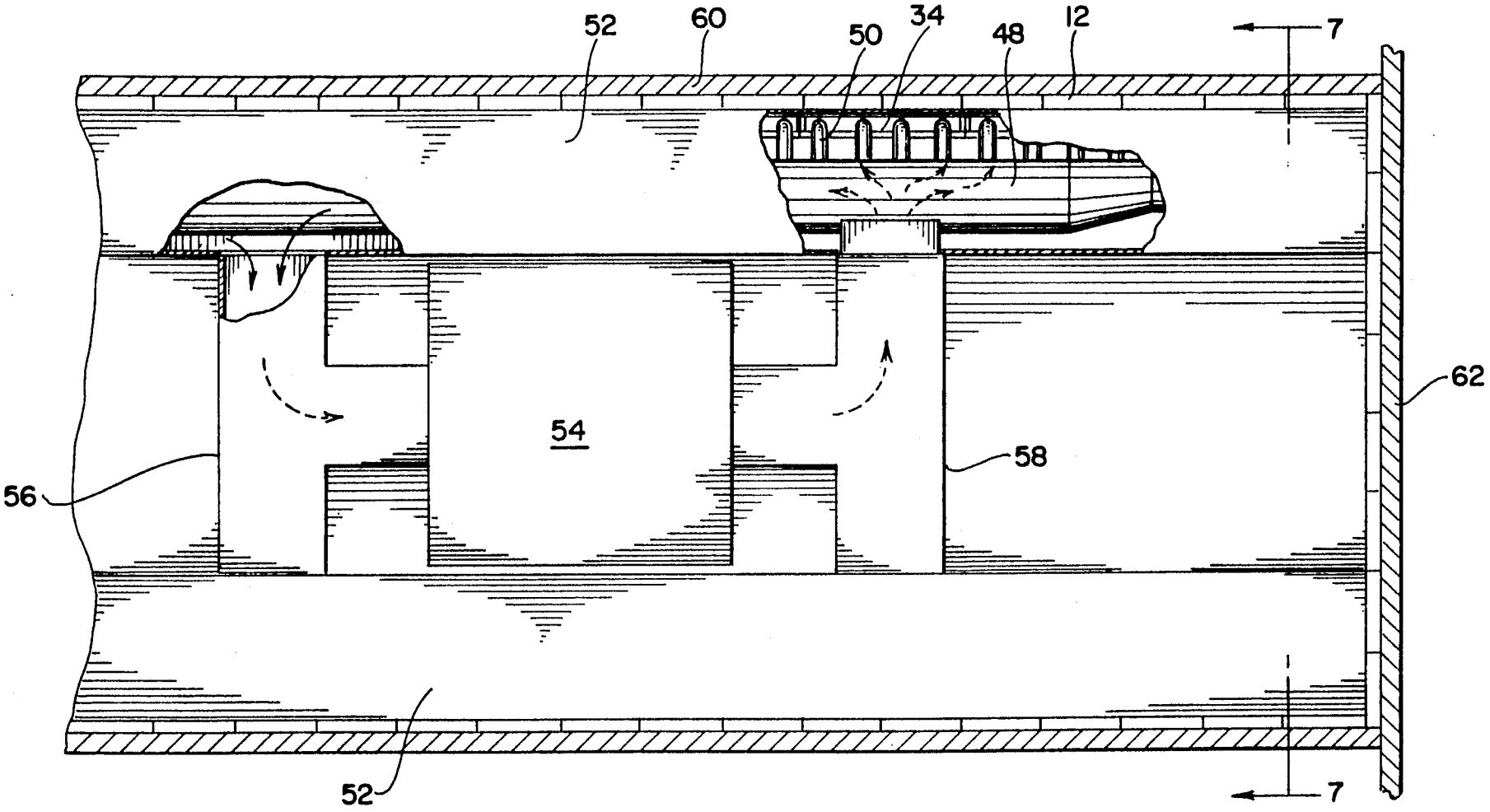
FIG. 6 is a fragmentary top plan view of the drying chamber of the present invention showing the air handling unit that is employed as a part thereof, with portions broken away for purposes of illustration.
Figure 7:
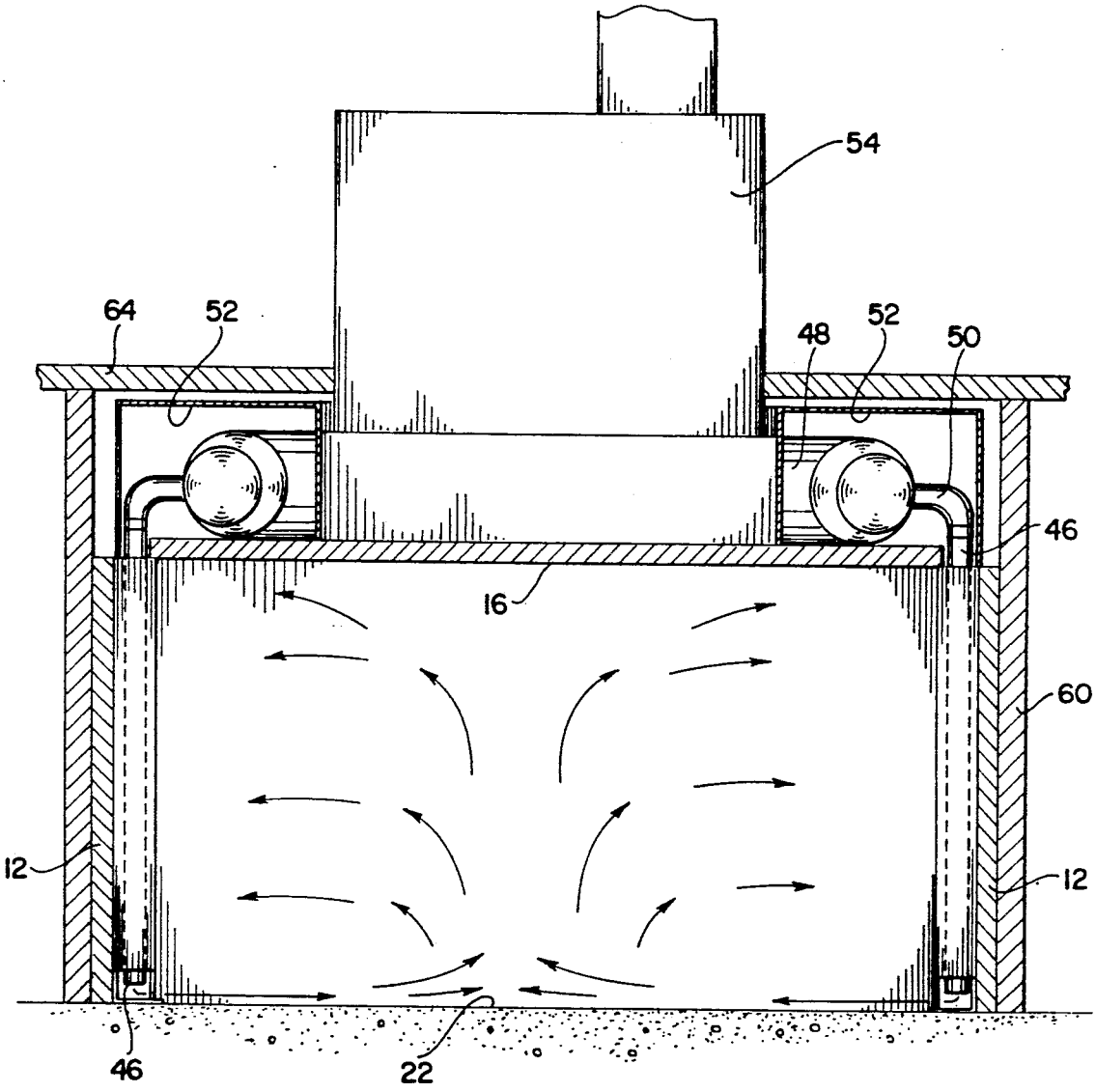
FIG. 7 is a section taken on line 7—7 of FIG. 6.

As will be seen most clearly in FIG. 7, modular walls 12, 14 and 16 are actually covered by outer side walls 60, end walls 62, and top wall 64, see FIGS. 6 and 7.

In operation and use, the pallets having stacked trays thereon are positioned in chamber 10 so as to substantially completely fill the chamber, i.e., the space defined by floor 22, side walls 12, end walls 14, and ceiling or top wall 16. Air that has been conditioned so as to have the desired temperature and humidity is then introduced to the supply tubes 46 by blower 54, the conditioned air passing downwardly through said tubes and exiting at the bottom ends thereof so as to provide a web of conditioned air emanating from the lower ends of each of the side walls, which conditioned air simultaneously passes horizontally from opposite sides of the chamber beneath the pallets 18. By controlling the air velocity and volume of the conditioned air, the distance through which the web will travel horizontally before the energy contained therein is expended can be predetermined, and specifically, the air velocity and volume are controlled so that the webs of air passing inwardly from opposite sides of the chamber will each move to approximately the center of the chamber, at which point the conditioned air will tend to move vertically upwardly through the center vertical space between the two innermost pallets of stacked trays, said upward movement at least partially resulting from the fact that the conditioned air is drier and hence lighter in density than the ambient air in the chamber. In actual practice, some of the conditioned air will also move upwardly through the other vertical spaces between the stacked trays, due to flow resistance which inherently results when the opposing webs of air meet at the center of the chamber. In the meanwhile, the suction side of blower 54 imparts a vacuum to the exhaust chambers 52, which exhaust chambers are in communication with the open upper ends of the plenums 32, whereupon a suction is imparted to the space within each plenum that surrounds the supply tubes 46, which suction communicates with the interior of chamber 10 by means of the perforations 36 in front wall 34. Thus, as the conditioned air begins to move vertically upward between the pallets of stacked trays, the suction being imparted to the interior of chamber 10 through the walls 34 will cause the conditioned air to flow horizontally between adjacent trays toward the walls 34, thereby effectively drying the products positioned on the individual trays. The arrows in FIG. 7 generally illustrate the flow path of the conditioned air. As a specific example, drying chamber 10 has been found to be effective where a total of 13 plenums are mounted on each side wall, with each plenum being approximately 4' wide, 7 ⅜' high, and 8 ½" deep. The approximate diameter of each of the supply tubes 46 is 5", and the perforations 36 in wall 34 comprise 22% of said wall area.

The present invention is applicable to both manual and automated systems, and in the latter, where continuous pallet transport systems are employed utilizing a plurality of adjacent drying chambers, it has been found desirable to provide double-faced plenums, i.e., plenums wherein both the front and rear walls are perforated, so that the plenums may actually function as the dividing wall between adjacent chambers, with conditioned air being introduced to and evacuated from each of said adjacent chambers by said dividing wall.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A drying chamber for curing products loaded on stacked trays that substantially completely fill said chamber, said trays having horizontal air spaces between adjacent stacked trays and beneath said stack, and having a vertical air space along one side of said stack, the improvement comprising means for evenly supplying, distributing, and exhausting conditioned air with respect to said chamber, said means comprising a plenum on the side of said chamber opposite from said one side of said stacked trays, said plenum having a foraminous front wall that faces the interior of said chamber, end walls, a rear wall, and a bottom wall, a plurality of side-by-side supply tubes extending vertically through said plenum, said tubes each having an open bottom end communicating with the lowermost portion of said chamber, means for supplying conditioned air to said supply tubes, and means for imparting a suction to the interior of said plenum surrounding said supply tubes, whereby conditioned air flowing downwardly through said supply tubes exits at the open bottom ends thereof to form a web of conditioned air that passes beneath the stack of trays until it reaches said vertical air space, and then rises upwardly therethrough, while at the same time the suction imparted to the plenum interior communicates with the chamber through said foraminous plenum wall to cause the conditioned air that is rising to flow outwardly through said horizontal air spaces into the plenum interior through said foraminous wall.

2. In the drying chamber of claim 1, said plenum comprising a plurality of individual modular units arranged side by side.

3. The drying chamber of claim 1 further characterized in that said chamber has said plenums on opposite side walls thereof, there being a plurality of rows of said stacked trays with said vertical air space located approximately halfway between said opposite side walls, whereby a web of conditioned air passes beneath the stacks of trays from opposite sides of the chamber to the approximate center thereof where said webs merge and then rise upwardly through said vertical air space and diverge horizontally outwardly in opposite directions through said horizontal air spaces.

4. In the drying chamber of claim 3, said plenums each comprising a plurality of individual modular units arranged side by side.

5. In the drying chamber of claim 1, the cross-sectional area of said plenum interior, not including the supply tubes, being approximately two to three times the total cross-sectional area of said supply tubes.

6. In the drying chamber of claim 1, the openings in said foraminous plenum wall comprising approximately 20% to 25% of the area of said wall.

7. In the drying chamber of claim 1, said means for supplying conditioned air comprising a blower having a pressure side and a suction side, a first manifold in communication with said pressure side, said supply tubes being in communication with said first manifold whereby conditioned air from said blower pressure side passes through said first manifold to each of said supply tubes, and a second manifold in communication with the blower suction side, and means interconnecting said second manifold with said plenum interior, in order to impart suction thereto.

8. In the drying chamber of claim 7, said first and second manifolds being concentrically mounted with respect to each other.

* * * * *